US005915870A

United States Patent [19]

Hamilton, Jr.

[11] Patent Number: 5,915,870

[45] Date of Patent: Jun. 29, 1999

[54] WRITING INSTRUMENT WITH CARTRIDGE SPACING ELEMENT

[75] Inventor: Arthur R. Hamilton, Jr., Indian Rocks Beach, Fla.

[73] Assignee: BIC Corporation, Milford, Conn.

[21] Appl. No.: 08/974,566

[22] Filed: Nov. 19, 1997

[51] Int. Cl.[6] ..... B43K 7/02

[52] U.S. Cl. ..... 401/210; 401/54

[58] Field of Search ..... 401/210, 213, 401/208, 221, 222, 223, 145, 153, 183, 54, 6

[56] References Cited

U.S. PATENT DOCUMENTS

| | | | |
|---|---|---|---|
| 2,829,623 | 4/1958 | Barnes | 401/210 |
| 3,180,320 | 4/1965 | Groft | 401/210 |
| 3,458,266 | 7/1969 | Douglas | 401/209 |
| 3,614,246 | 10/1971 | Lotfallah | 401/101 |
| 3,626,483 | 12/1971 | Whetstone et al. | 181/0.5 |
| 4,092,073 | 5/1978 | Anderson | 401/209 |
| 4,115,015 | 9/1978 | Torii | 401/110 |
| 4,167,350 | 9/1979 | Harris | 401/54 |
| 4,377,349 | 3/1983 | Kunii | 401/115 |
| 5,207,524 | 5/1993 | Arnold III | 401/210 |
| 5,294,206 | 3/1994 | Mukunoki | 401/54 |

*Primary Examiner*—David J. Walczak
*Attorney, Agent, or Firm*—Pennie & Edmonds LLP

[57] ABSTRACT

An improvement for a writing instrument consists of an elastomer spacing element disposed within the interior of the writing instrument. The improved writing instrument accepts ink cartridges that are within a range of lengths. Relatively short cartridges are held in place and prevented from independent movement by the spacing element. Conversely, relatively lengthy ink cartridges cause the spacing element to be compressed.

19 Claims, 2 Drawing Sheets

WRITING INSTRUMENT WITH CARTRIDGE SPACING ELEMENT

BACKGROUND OF THE INVENTION

1. Technical Field

The present invention is directed to an improvement to writing instruments, wherein the writing instrument is easily and inexpensively capable of accepting ink cartridges of longer or shorter than normal length. In particular, the improvement includes a resilient spacing element which decreases the nominal length of the cartridge chamber, but allows compressible contact with a cartridge longer than that nominal length.

2. Discussion of the Related Art

Ink writing instruments are well known in the art and are available in both disposable and non-disposable forms. Non-disposable forms typically utilize replaceable ink cartridges that are inserted into a chamber within the instrument. When one replaceable ink cartridge is exhausted, a user simply removes it and inserts a new one.

Not all cartridges fit all writing instruments however; non-disposable writing instruments that employ ink cartridges are typically constructed with the intention of using cartridges of a specified length. Therefore, a user is often forced to rely upon one brand or type of cartridge for a particular writing instrument. Complicating this situation are cartridges that are close to normal size but are somewhat shorter or longer. Shorter cartridges may fit within a prior art writing instrument, but because they are of less than normal length, remain loose within the cartridge chamber. Although the user may be able to make use of the writing instrument with such a cartridge installed, the cartridge tends to slip and slide around within the chamber, resulting in noise and an unstable feeling within the user's hand, thus distracting the user from making smooth strokes.

Similarly annoying are ink cartridges that are of slightly longer than normal length. When a cartridge is substantially longer than normal, the user can tell at a glance that it will not fit within the chosen writing instrument. However, with cartridges that are only slightly longer than normal, the user cannot discern whether it will fit or not until he or she attempts to install it within the cartridge chamber.

Most non-disposable writing instruments consist of two or more separable sections which, when joined, create the cartridge chamber and envelope the ink cartridge. When the sections of a particular writing instrument connect and release via screwing and unscrewing complementary threaded portions, the writing instrument may, by not completely screwing the portions together, be capable of enclosing a cartridge that is too long. This remains unsatisfactory to the user, however, as the instrument then has a tendency to unscrew further, to the point of disassembly. In addition, the incomplete union of the instrument segments is likely to feel uncomfortable within the user's grasp.

SUMMARY OF THE INVENTION

In view of the disadvantages of the prior art, it is an object of the present invention to provide a writing instrument that is capable of securely accepting ink cartridges that are of less than normal length, so that such cartridges are prevented from easily moving about within the cartridge chamber.

It is a further object of the invention to accept cartridges that are of longer than normal length without affecting the external appearance or assembly of the writing instrument.

It is also an object of the invention to provide the above advantages with a device which is both uncomplicated and occupies a small area within the writing instrument.

In a writing instrument according to the present invention, an improvement is provided including a spacing element assembly that allows the insertion and use of ink cartridges within a range of lengths. A conventional non-disposable writing instrument includes a main cylindrical portion which encloses a chamber in which resides an ink cartridge, an upper end from which protrudes the writing point of the ink cartridge, and a lower end. Connected to the lower end of the writing instrument by a support member is an O-ring shaped spacing element. When the chamber is empty, the spacing element reduces the longitudinal length of the ink cartridge chamber, thus allowing relatively short ink cartridges to be inserted and snugly ensconced therein.

Relatively long cartridges may also be inserted, in which event the spacing element is compressed, thereby lengthening the ink cartridge chamber.

BRIEF DESCRIPTION OF THE DRAWINGS

These and other features, aspects, and advantages of the present invention will become more readily apparent from the following detailed description, which should be read in conjunction with the accompanying drawings, in which.

DETAILED DESCRIPTION OF THE INVENTION

Figure 1:
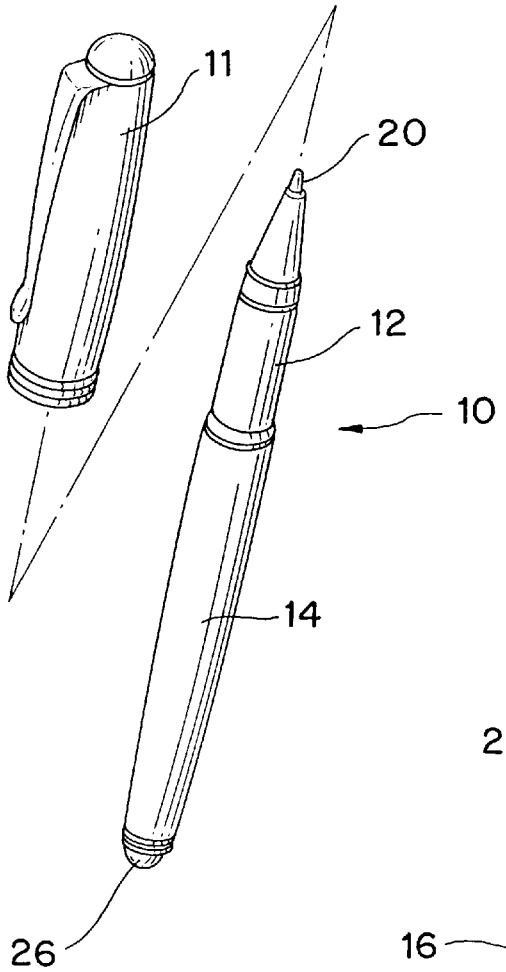
FIG. 1 is a perspective view of a writing instrument according to the present invention.

The following embodiments are described in the context of a writing instrument that employs ink cartridges. Note that whenever the same reference numeral is repeated with respect to different figures, it refers to the corresponding structure in each figure.

Figure 2:
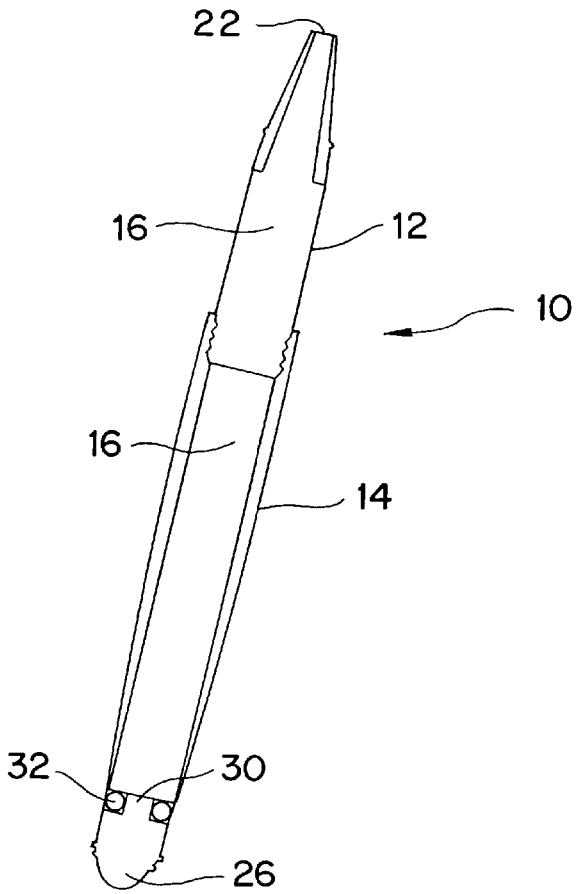
FIG. 2 is a longitudinal sectional view of a writing instrument employing one embodiment of the present invention.

FIGS. 1 and 2 depict an illustrative embodiment of a writing instrument employing the present invention. The body of writing instrument 10 is comprised of upper portion 12 and lower portion 14 which rotatably join to form chamber 16 in which resides ink cartridge 18 (shown in FIG. 3). Button 26 attaches to lower portion 14 and forms one end of writing instrument 10. When writing instrument 10 is not in use, cap 11 encloses the opposite, writing, end.

Figure 3:
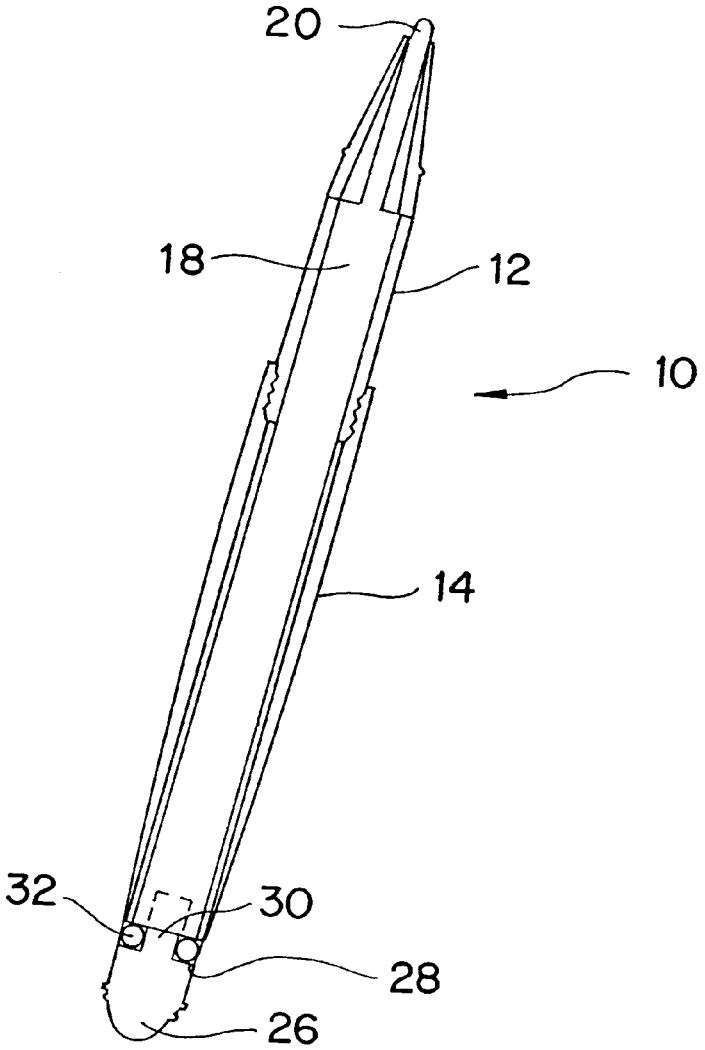
FIG. 3 is a longitudinal sectional view of a writing instrument according to the present invention, with an ink cartridge installed.

As seen in FIG. 3, in normal operation upper portion 12 is fully joined with lower portion 14, and cartridge 18 substantially fills the longitudinal length of chamber 16. Tip 20 of cartridge 18 extends through bore 22 of upper portion 12, and spacing element 32 meets the lower end of cartridge 18.

Figure 4:
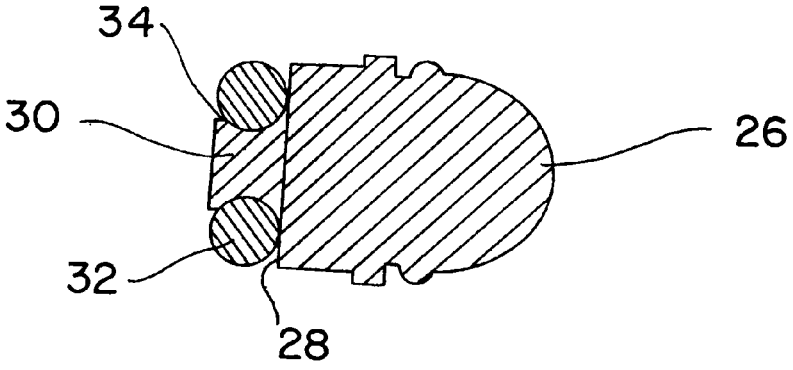
FIG. 4 is a partial sectional view of the embodiment of the invention depicted in FIGS. 2 and 3.

In FIG. 4, button 26 can be seen to support spacing element 32 for yieldable interaction with cartridge 18. As may be appreciated with reference to FIG. 3, button 26 is connected to lower portion 14 of the body of writing instrument 10, thereby connecting spacing element 32 to the body of writing instrument 10. Spacing element 32 yieldably compresses as necessary to allow writing instrument 10 to accept cartridges having a range of lengths. Post 30, cylindrical in this illustrative embodiment, extends from surface 28 of button 26, preferably at a ninety degree angle. Post 30 removably supports spacing element 32 and attaches spacer 32 to the body of writing instrument 10. The first end of post 30 is attached to button 26, whereas the circumference of the opposite, second end of post 30 is surrounded by an annular flange 34 and, as described below, cooperates with the lower end of cartridge 18. The outer diameter of the annular flange 34 surrounding the upper end of post 30 is larger than the inner diameter of spacing element 32, thereby ensuring a secure fit of spacing element 32 to post 30.

Cartridge 18 includes a body comprising an ink reservoir and a bore extending inward from its lower end, opposite button 26, of slightly greater diameter than the annular flange 34 surrounding the upper end of post 30.

Upon insertion of a relatively long ink cartridge, the bore receives post 30 as spacing element 32 is compressed. In an alternative embodiment, not pictured, instead of being encircled by a flange, the upper end of post 30 is chamfered.

When an ink cartridge is exhausted, the user unscrews the main body of the writing instrument, removes the exhausted cartridge and inserts a new one, typically by first inserting the tip into upper portion 12 and then screwing lower portion 14 onto upper portion 12. The present invention allows the user to insert a cartridge that does not extend all the way to surface 28 of button 26 when upper portion 12 and lower portion 14 are screwed together. Spacing element 32 fills the gap that would otherwise exist between cartridge 18 and button 26, thus preventing cartridge 18 from sliding around within chamber 16.

Similarly, because spacing element 32 is compressible, the user can insert cartridges that are longer than the distance from bore 22 to spacing element 32. Instead of being limited to using such a cartridge with the upper and lower portions of the writing instrument partially unscrewed, spacing element 32 will be compressed by the extended cartridge, and post 30 will extend into the bore situated in the corresponding end of cartridge 18, with no adverse effect upon or difference in appearance of the writing instrument.

In an exemplary embodiment, spacing element 32 is a torus, such as a deformable O-ring with a thickness of 0.076 inches; illustrative materials for its construction include various synthetic rubber materials such as nitrile, silicone, and polyurethane. Depending upon the material used, maximum compressibility of this embodiment is 0.018 inches.

The above description is intended to be illustrative, not limitative. Thus, it will be apparent to those skilled in the art that modifications may be made to the invention as described without departing from the scope of the claims set out below. For example, instead of employing an O-ring shaped spacing element, thus giving it a circular cross-section, an alternative embodiment employs a square cross-section.

I claim:

1. A writing instrument having first and second ends and comprising:

a main body having a first portion and a second portion joined together to define an elongated cavity therein, said cavity having a first end adjacent said first end of said writing instrument and a second end adjacent said second end of said writing instrument;

an ink cartridge disposed within said elongated cavity, said ink cartridge having a length which does not correspond exactly to the length of said elongated cavity;

a spacer support disposed in said cavity at an end thereof:

a yieldable spacer supported on said spacer support;

wherein said yieldable spacer accommodates the ink cartridge length by yieldably contacting and end of said ink cartridge to provide a snug fit of said ink cartridge in said cavity.

2. The writing instrument of claim 1, wherein said spacer is made from an elastomer.

3. The writing instrument of claim 2, wherein said spacer is of an annular form.

4. The writing instrument of claim 1, wherein said spacer support is connected to said main body.

5. The writing instrument of claim 4, wherein said spacer is removably attached to said spacer support.

6. The writing instrument of claim 1, wherein said spacer yieldably contacts an ink cartridge shorter than a specified length, so as to substantially eliminate independent movement of said ink cartridge within said writing instrument cavity.

7. The writing instrument of claim 1, wherein said spacer compresses to allow said writing instrument to accept an ink cartridge longer than a specified length.

8. The writing instrument of claim 1, further comprising a button forming a first end of said main body, said spacer support extending from said button into said cavity.

9. The writing instrument of claim 1, wherein said spacer support comprises:

a cylindrical shaft;

a first end coupled to said main body; and a second end opposite said first end.

10. The writing instrument of claim 9, wherein said second end of said spacer support has a circumference surrounded by an annular flange.

11. The writing instrument of claim 9, wherein said ink cartridge comprises:

a tip;

a body comprising an ink reservoir; and an end said end comprising having a bore defined therethrough;

wherein said cylindrical shaft and said bore each have a respective diameter, the diameter of said bore being larger than the diameter of said cylindrical shaft.

12. A writing instrument comprising:

a main body defining a cavity for housing an ink cartridge, the ink cartridge having an associated length; and a spacer element formed from a compressible material and disposed on a support element within a first end of said cavity;

wherein the compressibility of said spacer element enables said cavity to snugly accept an ink cartridge having one of a range of lengths.

13. The writing instrument of claim 12, further comprising a button mounted on said main body adjacent said first end of said cavity, said spacer element being mounted on said button and thereby connected to said main housing.

14. The writing instrument of claim 12, wherein said spacer element is a torus.

15. The writing instrument of claim 14, further comprising a support post for attaching said spacer element to said main body.

16. The writing instrument of claim 15, wherein said support post has a free end surrounded by an annular flange.

17. The writing instrument of claim 16, wherein said flange on said support post is sized to ensure a secure fit of said spacer element to said post.

18. The writing instrument of claim 16, wherein said flange on said support post is sized for insertion into a bore in the ink cartridge.

19. The writing instrument of claim 10, wherein said annular flange on said spacer support is sized and shaped for insertion into a bore in said ink cartridge.

* * * * *

UNITED STATES PATENT AND TRADEMARK OFFICE
CERTIFICATE OF CORRECTION

PATENT NO. : 5,915,870

DATED : June 29, 1999

INVENTOR(S) : Hamilton, Jr.

It is certified that error appears in the above-identified patent and that said Letters Patent is hereby corrected as shown below:

In claim 1, column 3, line 65, please change "and" to --an--.

In claim 11, column 4, line 32, please delete "said end comprising".

Signed and Sealed this

Tenth Day of April, 2001

*Attest:*

Nicholas P. Godici

NICHOLAS P. GODICI

*Attesting Officer*

*Acting Director of the United States Patent and Trademark Office*